US006896174B2

(12) United States Patent
Gosis et al.

(10) Patent No.: US 6,896,174 B2
(45) Date of Patent: May 24, 2005

(54) SINGLE PIECE PACKAGING CONTAINER

(75) Inventors: Anatoly Gosis, Palatine, IL (US); Michael D. Loeschen, Hawthorn Woods, IL (US); Ian Brooks, Lake Barrington, IL (US); Lee A. Sheridan, Barrington, IL (US); G. Michael Velan, Mt. Prospect, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 44 days.

(21) Appl. No.: 10/264,506

(22) Filed: Oct. 4, 2002

(65) Prior Publication Data

US 2004/0065725 A1 Apr. 8, 2004

(51) Int. Cl.[7] ..... B65D 5/00

(52) U.S. Cl. ..... 229/103.2; 229/125.19; 229/143

(58) Field of Search ..... 229/125.22, 103.2, 229/143

(56) References Cited

U.S. PATENT DOCUMENTS

| | | | | |
|---|---|---|---|---|
| 1,069,021 A | | 7/1913 | Miller | |
| 1,102,820 A | * | 7/1914 | Thompson | 229/143 |
| 1,758,230 A | | 5/1930 | Lange | |
| 1,871,888 A | | 8/1932 | Johnson | |
| 1,880,191 A | * | 10/1932 | Bigelow | 229/143 |
| 2,077,694 A | * | 4/1937 | Hinton | 229/101 |
| 2,194,669 A | | 3/1940 | Mumford | |
| 2,317,884 A | | 4/1943 | Clouston | |
| 2,731,167 A | | 1/1956 | Moore | |
| 3,543,994 A | | 12/1970 | Clark | |
| 3,552,633 A | | 1/1971 | Ketler | |
| 3,669,338 A | | 6/1972 | Cornell et al. | |
| 3,833,116 A | | 9/1974 | Howe | |
| 4,067,442 A | * | 1/1978 | Howe | 206/433 |
| 4,607,750 A | | 8/1986 | Valenti | |
| 4,629,069 A | | 12/1986 | Pugh | |
| 4,662,512 A | | 5/1987 | Durand | |
| 4,871,067 A | | 10/1989 | Valenti | |
| 4,976,374 A | | 12/1990 | Macaluso | |
| 5,141,149 A | | 8/1992 | Fulton | |
| 5,657,872 A | | 8/1997 | Leftwich et al. | |
| 6,027,017 A | | 2/2000 | Kuhn et al. | |
| 6,382,447 B1 | | 5/2002 | Loeschen | |
| 6,499,655 B1 | | 12/2002 | Moen | |

* cited by examiner

*Primary Examiner*—Tri M. Mai
(74) *Attorney, Agent, or Firm*—Mark W. Croll, Esq.; Donald J. Breh, Esq.; Welsh & Katz, Ltd.

(57) ABSTRACT

A packaging container is formed from a single preformed, rigid unit of U-shaped cross-section having a generally flat bottom wall. The unit forms two end closures from first and second closure panels extending from both ends of a main body portion. The closure panels are foldably connected to the main body portion and each other by first and second fold lines. The main body side walls have straight-cut corners at junctures with the first closure panels, and the first closure panel side walls have straight-cut corners adjacent to the main body, forming square corners when folded. The first closure panel side walls also have straight-cut corners adjacent to the second closure panels, and the second closure panels side walls have straight-cut corners adjacent to the first closure panels, forming square corners when folded to form the end closures.

8 Claims, 6 Drawing Sheets

126 OR 124
144
140

104
122
108
106
124
126
116
118
127
112
B
114
140
132
136
134
110
130

SINGLE PIECE PACKAGING CONTAINER

BACKGROUND OF THE INVENTION

The present invention is directed to a packaging container. More particularly, the present invention pertains to a packaging container having self-formed end closures, created from a single piece of material.

Packaging for lengthy items takes many forms. One construction includes a pair of corrugated, laminated paperboard top and bottom U-shaped channels configured for one to fit within the other. Most packages formed in this manner require separated end closures or caps, usually manufactured from cardboard or wood. These caps generally are stapled to adjacent package walls. Not only does this method necessitate close-fit manufacturing, but it is also very cumbersome at installation, and may cause content damage due to incompletely formed or off-positioned staples.

In another variety of packaging container, one of the top and bottom U-shaped channels has a notch cut into opposing side walls of the "U," so that the "U" portion may be folded over at a 90 degree angle. In such a configuration, channel ends are closed by the folded base portion and the side walls of the "U," which are folded over adjacent side walls. To seal such a package, tape or a like strip-type adhesive sealant must be extended over the flaps that then are folded over the adjacent side walls. Even though a seal may be formed, however, openings may remain at the juncture of the folded-over base portion and the cover portion, seriously weakening the package. This design is disclosed in U.S. Pat. No. 4,976,374, which is incorporated herein by reference.

Another existing packaging container, disclosed in U.S. Pat. No. 6,382,447, resolves the above-referenced problems by providing a packaging container in which the entirety of the end closure is formed from the packaging material itself. However, the container base unit, which forms end closures for the packaging container, features mitered corners. These mitered corners require complex die-cutting with mirrored tools, and mandatory strapping at specific positions to restrain the miter flaps.

Accordingly, there exists a need for a single-piece packaging container cut without miters in which the entirety of the end closures are formed from the packaging material itself. Desirably, the container's end closures meet or overlap along the container's main body portion, providing a high degree of structural strength and package integrity while requiring only a central tape sealing. Such a configuration allows for no gaps at its closure locations. Most desirably, the container may be prepared simply by making two straight saw-cuts on each package end.

BRIEF SUMMARY OF THE INVENTION

A packaging container includes a preformed, rigid unit of U-shaped cross-section having a main body portion with a generally flat bottom wall and opposing side walls. The unit forms two end closures, at each end of the packaging container. Each end closure is formed from a first closure panel extending from and adjacent to an end of the main body portion, and a second closure panel extending from and adjacent to an end of a first closure panel. The main body portion and the first closure panels are foldably connected to each other by first fold lines. The first closure panels and the second closure panels are foldably connected to each other by second fold lines.

For purposes of the present disclosure, the package material, although defined as having a U-shaped cross-section is, in fact, formed from a material having a channel-like or squared U-shape having a flat or near-flat bottom wall. The corners may be formed having a radius of curvature (i.e., rounded) or they may be formed having relatively sharp angles. However, again, for purposes of the present disclosure, the container material is referred to as "U-shaped".

The main body portion side walls have straight-cut corners at their junctures with the first closure panel, and the first closure panels side walls have first straight-cut corners adjacent to the main body. The first closure panels side walls additionally have second straight-cut corners adjacent to the second closure panels, and the second closure panels have straight-cut corners adjacent to the first closure panels.

The first closure panels are configured for folding generally perpendicular to the main body bottom wall, and the second closure panels are configured for folding generally perpendicular to the first closure panels and generally parallel to the main body bottom wall.

In a preferred embodiment, the main body side walls are about equal in height to the first and second closure panels side walls. Preferably, the first and second closure panels side walls are configured for insertion inside the main body side walls when the end closures are formed. Most preferably, each second closure panel is at least half as long as the main body portion.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
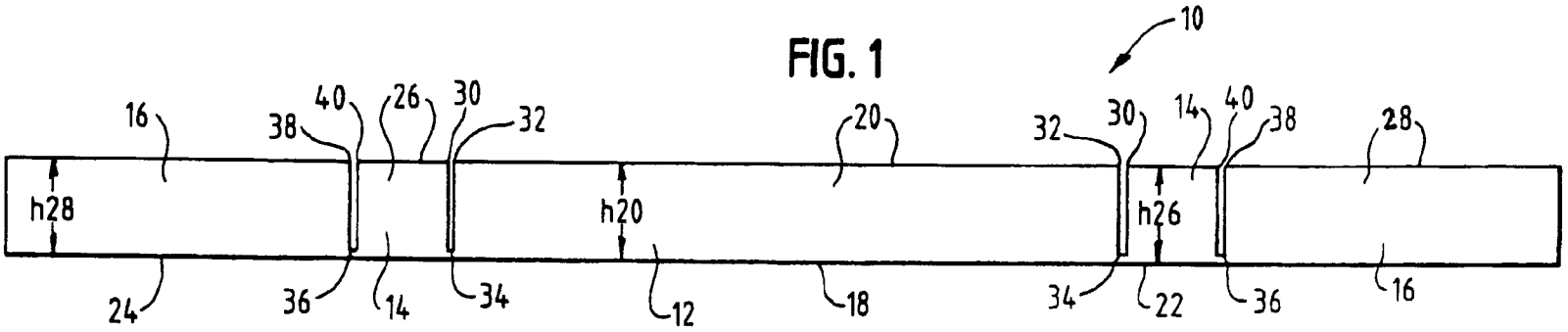
FIG. 1 is a side plan view of an open blank of an embodiment of the single-piece packaging container with straight-cut end closures constructed in accordance with the principles of the present invention, the container being show with its first and second closure panels laid open, prior to construction.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Figure 1A:
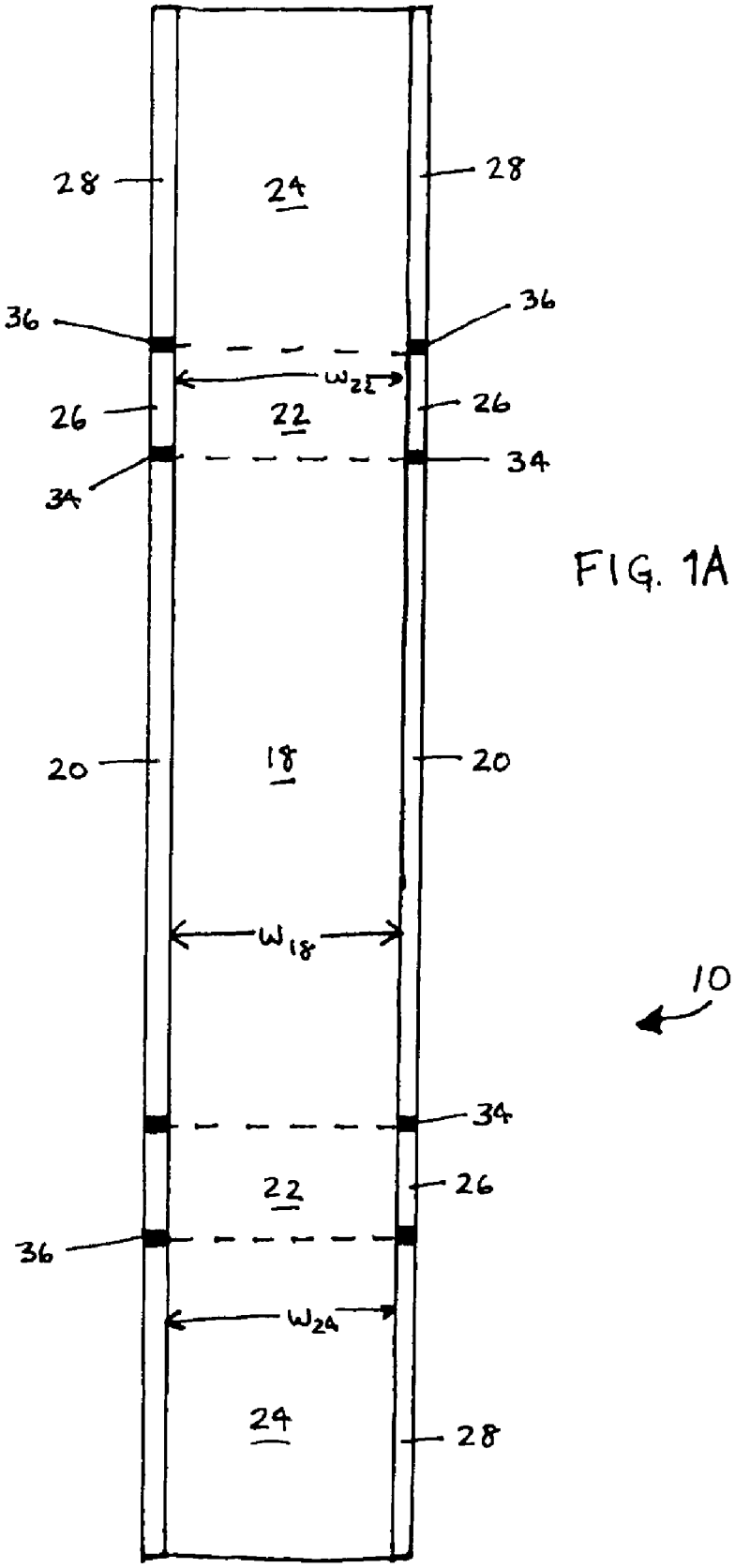
FIG. 1A is a top view of the blank of FIG 1.

Referring now to the figures and in particular FIGS. 1 & 1A, there is shown a packaging container 10 embodying the principles of the present invention. The packaging container is formed in an U-shaped cross-section. Preferably, the packaging container is formed from laminated paperboard material. The packaging container includes a main body portion 12, first closure panels 14, and second closure panels 16. The straight-cut first and second closure panels 14, 16 are formed from an extension of the main body portion 12. The main body portion 12 has a generally flat bottom wall 18 and upstanding side walls 20. The first and second closure panels 14, 16 also have bottom walls 22, 24 and upstanding side walls 26, 28. Again, those skilled in the art will appreciate that although the container is referred to as "U-shaped," the package actually is formed from a channel-like structure having a flat or near-flat bottom wall 18.

The first closure panels 14 are formed adjacent to and at either end of the main body portion 12. The side walls 26 of the first closure panels 14 have first straight-cut corners 30. The main body side walls 20 also have straight-cut corners 32, immediately adjacent to the first panels' straight-cut corners 30. First fold lines or creases 34 can be formed between the main body bottom wall 18 and the first closure panels' bottom walls 22 at the junctures of the straight-cut corners 30, 32 to facilitate folding.

The second closure panels 16 are adjacent to the first closure panels 14. The second closure panels 14 are connected to the first panels 14 by second fold or crease lines 36 formed between the first closure panels' bottom walls 22 and the second closure panels' bottom walls 24, parallel to the first fold lines 34. The side walls 28 of the second closure panels 16 include straight-cut corners 38 at the junctures with the first closure panels 14. The side walls 26 of the first closure panels 14 include second straight-cut corners 40 adjacent to the second closure panels 16. The height $h_{20}$ of the main body side walls 20 is about equal to the heights $h_{26}$, $h_{28}$ of the first closure panels side walls 26 and the second closure panels side walls 28. In addition, the width $w_{18}$ of the main body bottom wall 18 is about equal to the widths $W_{22}$, $W_{24}$ of the first and second closure panels' bottom walls 22, 24.

Figure 2:
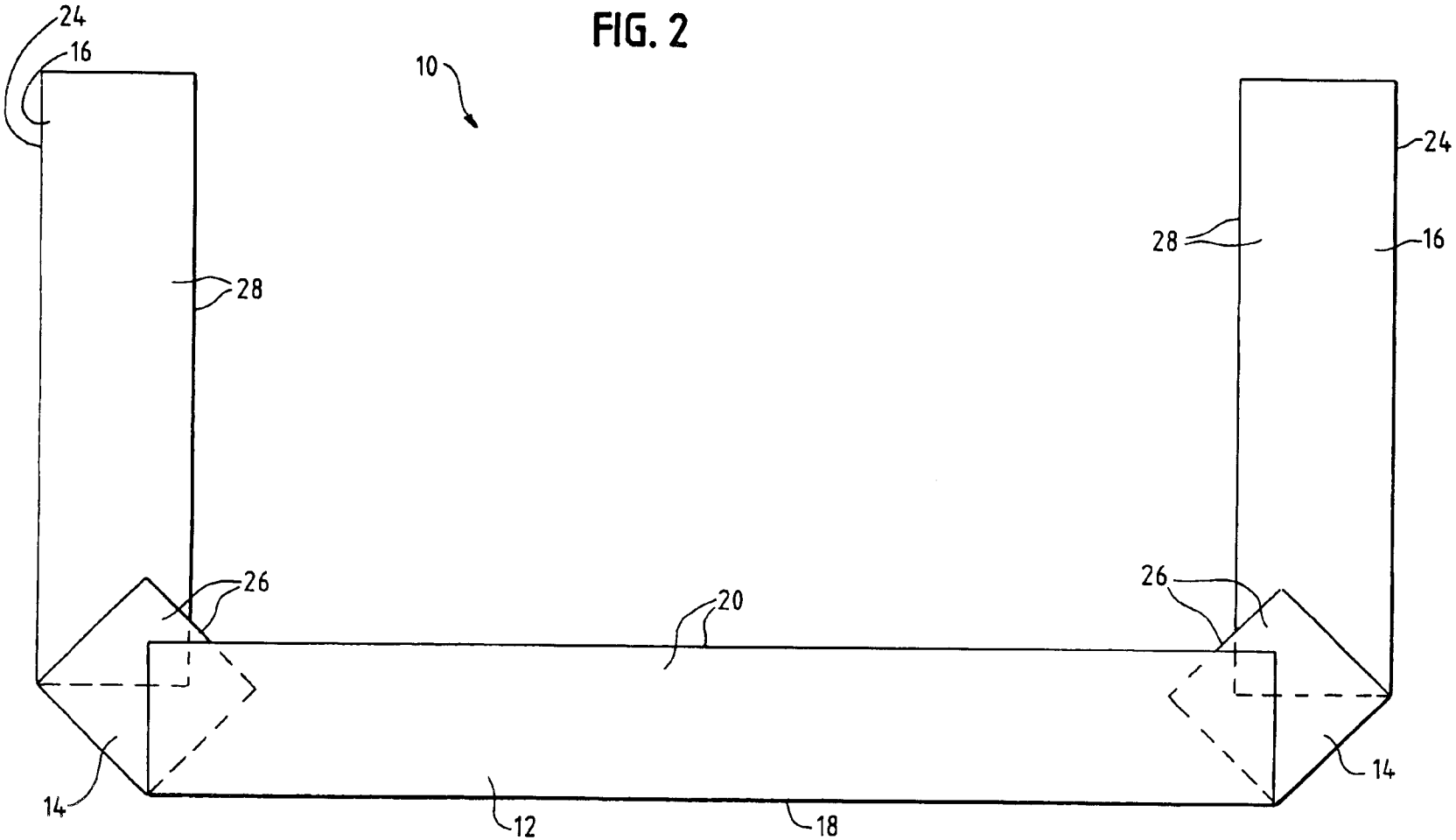
FIG. 2 illustrates the folding in-progress of the end closures of FIG. 1.

Referring to FIG. 2, assembling the package 10 is straightforward and readily carried out. The package 10 is placed on a surface, with the main body 12, and the first and second closure panels 14, 16 laid out flat. The articles to be packaged are placed in the main body portion 12. The first panels 14 are then folded upwardly, so that the first panels 14 are perpendicular to the bottom wail 18 of the main body portion 12. As the first panels 14 are folded, their side walls 26 can be inserted between the main body side walls 20. The second panels 16 are then folded over, perpendicular to the first panels 14, 50 that the bottom walls 24 of the second panels 16 lie parallel to the bottom wall 18 of the main body portion 12. As the second panels 16 are folded, their side walls 28 can be inserted between the side walls 20, 26 of the main body and the first panels 14. Because of their similar heights and widths, the first and second closure panels 14, 16 fit so tightly within the main body portion 12 that no seal is required to maintain the container 10 in a fully assembled, or "closed" state.

Figure 3:
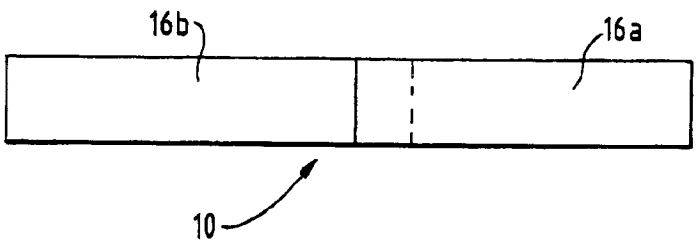
FIG. 3 is a bottom view of an embodiment of the packaging container, the container being shown in a fully constructed or assembled form and further shown with its second closure panels overlapping.

FIG. 3 shows the package 10 fully assembled, with one second panel 16*a* overlapping the other second panel 16*b*. A single, central tape sealing placed on the overlap may further secure the container 10, but is not necessary.

Figure 4:
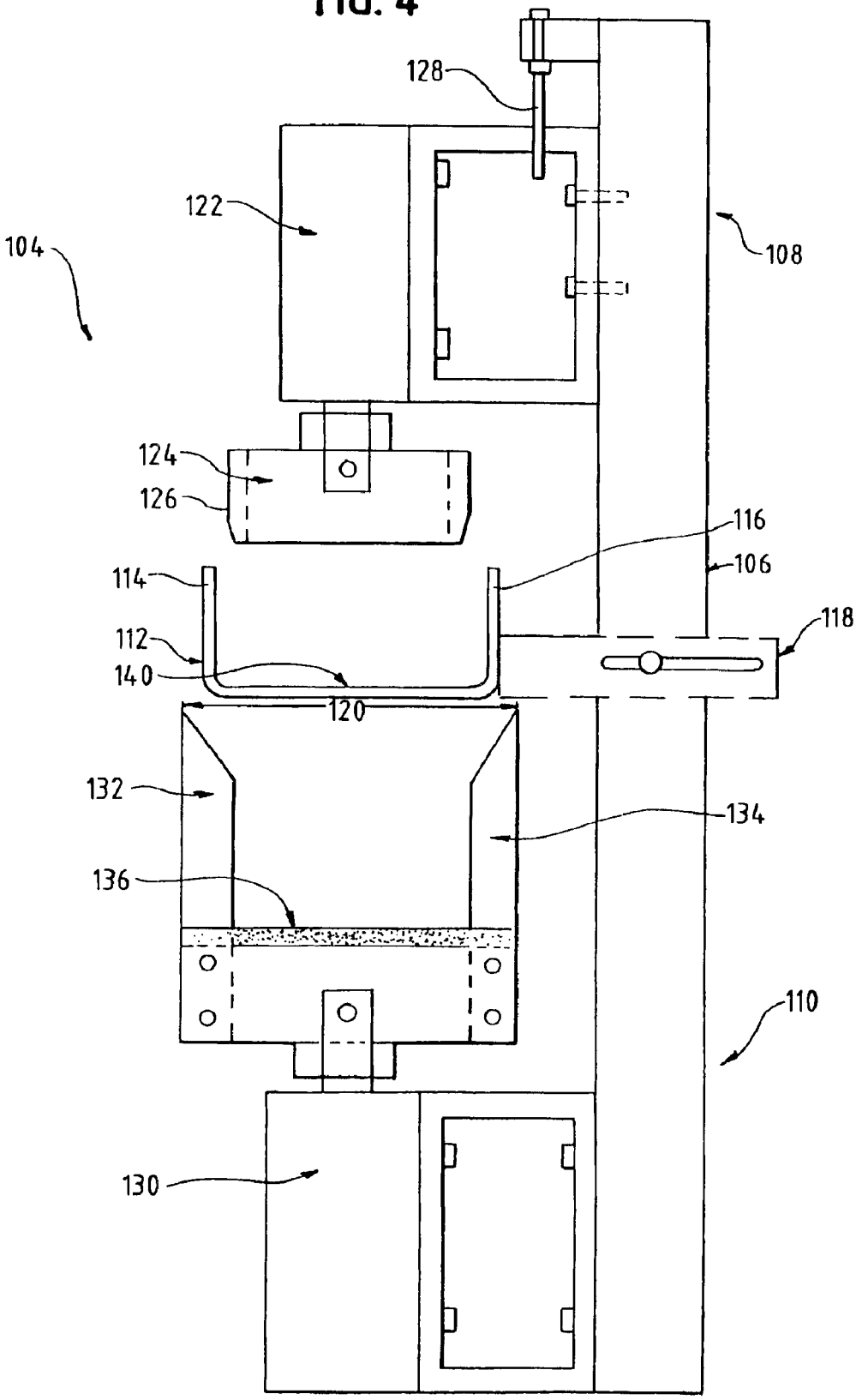
FIG. 4 is a side view of a device for straight-cutting and embossing U-shaped packaging crates, the device being shown in its at-rest position.
Figure 5:
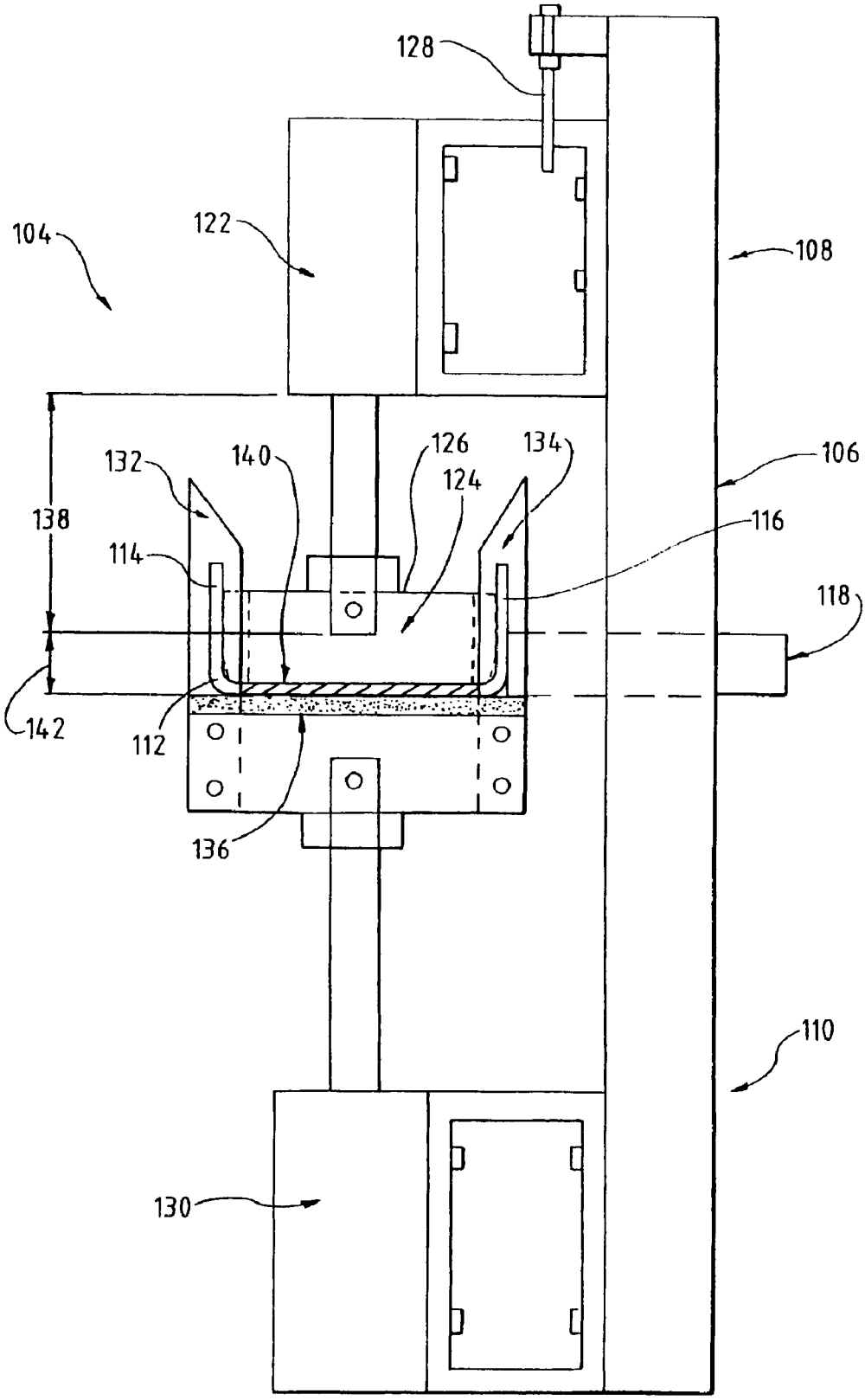
FIG. 5 illustrates the movements of the device of FIG. 4.
Figures 6, 7:
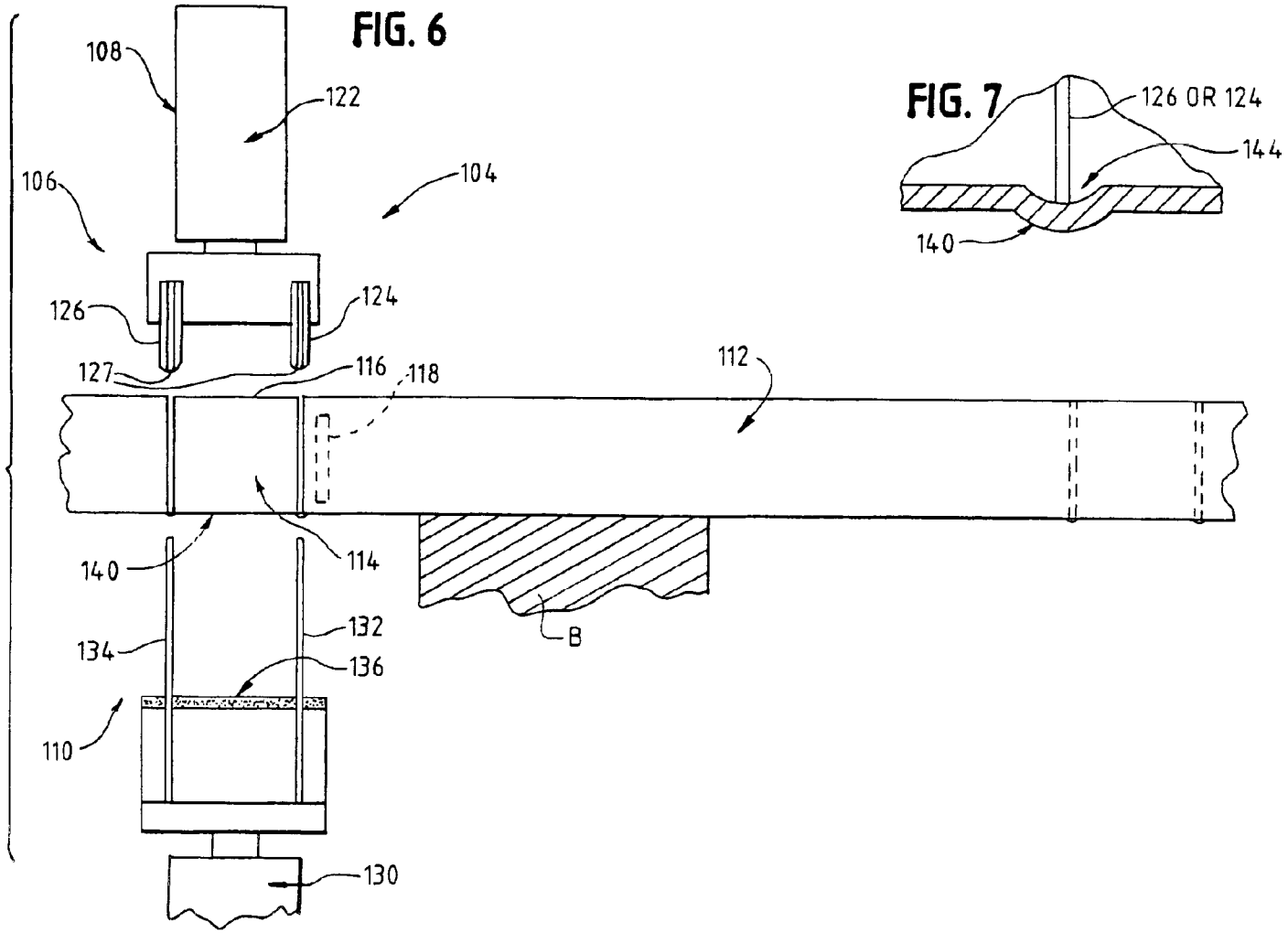
FIG. 6 is an alternate side view of the device of FIG. 4, the device being shown in its at-rest position.
FIG. 7 illustrates an indentation in a packaging crate resulting from use of the device.

Referring now to FIGS. 4–6, there is shown a device 104 for straight-cutting and embossing U-shaped packaging container sections 10, 210, 410. The device 104 includes a frame 106, having an upper embossing/guide assembly 108 and lower cutting assembly 110 mounted thereto. An exemplary U-shaped unit 112 with vertical side walls 114, 116 to be cut is positioned between the upper 108 and lower 110 assemblies. Preferably, the unit is supported by a bench or conveyor mechanism B. The unit 112 is centered and restricted from lateral movement by an adjustable centering arm 118, positioned outside of the cutting plane 120.

The upper assembly 108 includes a two-step air cylinder 122, tooled with dual embossing end-effectors 124, 126. A depth adjustment, such as the exemplary threaded element 128 vertically adjusts the position of the cylinder 122 to accommodate varying unit depths. The lower assembly 110 includes an air cylinder 130, includes two pairs of notching blades 132, 134 and an embossing return pad 136. Preferably, the embossing return pad 136 is made of a resilient material. In a preferred embodiment, the embossing return pad 136 is made of urethane.

Referring now to FIG. 4, at the start of the cutting cycle, both the upper 108 and lower 110 assemblies are clear of the unit 112. As a first step, following manual or automatic activation, the upper air cylinder 122 extends to a first pre-programmed depth 138, causing the end-effectors 124, 126 to come into contact with an internal bottom wall 140 of the unit 112. The end-effectors 124, 126 provide support for the crate bottom wall 140 and loosely fits between the vertical side walls 114, 116.

Once the device 104 senses that the first step is complete, the lower air cylinder 130 extends, causing the two pairs of notching blades 132, 134 to cut completely through the crate's vertical side walls 114, 116, leaving the crate's bottom wall 140 intact. As seen in FIG. 6, the end-effectors 124, 126 can include guides 127 formed as channels therein. The guides 127 provide a centering means to assure that the blades 132, 134 remain straight during the cutting cycle. As a third step, the two pairs of notching blades 132, 134 remain raised, causing the crate's bottom wall 140 to rest on the embossing return pad 136 (as seen in FIG. 5). Next, the upper air cylinder 122 extends to a second pre-programmed depth 142. The end-effectors 124, 126 therefore embed into the crate internal bottom wall 140, deforming the material into the embossing return pad 136. A resulting indentation 144, as see in FIG. 7, compresses the crate's bottom wall 140 along future bending lines, facilitating the formation of packaging containers. Finally, both the upper 108 and lower 110 segments return to their original positions, as in FIG. 4. As will be appreciated by those skilled in the art, the indentations form a region at which the material will more readily fold to form the container 10, 210, 410.

Advantageously, it has been found that the present device 104 can be used with container units 112 having a wide variety of wall 114, 116 heights with minimal to no adjustment. This increases the flexibility of the packager vis-á-vis selecting a proper package based upon the articles to be packaged, rather than a package for which the device is configured or designed.

In addition, it has been found that cutting rather than sawing the material provides a "cleaner" cut with respect to the ends of the material as well as debris that may be created during the cutting operation. It has further been found that the cutting blades 132, 134, moving toward the unattached (e.g., free-) ends of the walls 114, 116 prevents collapse of the walls 114, 116, regardless of the material thickness, during the cutting operation.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A packaging container, comprising:

a embossed preformed, rigid unit of U-shaped cross-section having a main body portion with a generally flat bottom wall and integral opposing side walls, and two end closures, formed from first closure panels with integral opposing side walls extending from and adjacent to both ends of the main body, and second closure panels with integral opposing side walls-extending from and adjacent to both ends of the first closure panels, the main body and the first closure panels being foldably connected to one another by first fold lines, and the first closure panels and the second closure panels being foldably connected to one another by second fold lines, the main body side walls having straight-cut corners at their junctures with the first closure panels and the first closure panels having first straight-cut corners adjacent the main body, the first closure panels side walls having second straight-cut corners adjacent the second closure panels and the second closure panels side walls having straight-cut corners adjacent the first closure panels, the first closure panels being configured for folding generally perpendicular to the main body bottom wall and the second closure panels being configured for folding generally perpendicular to the first closure panels and generally parallel to the main body bottom wall.

2. The packaging container in accordance with claim 1 wherein the main body side wall have a height that is about equal to a height of the first and second closure panels side walls.

3. The packaging container in accordance with claim 1 wherein the first and second closure panels side walls are configured for insertion inside the main body side walls when the end closures are formed.

4. The packaging container in accordance with claim 1 wherein each second closure panel is half as long as the main body portion.

5. The packaging container in accordance with claim 1 wherein the length of each second closure panel is greater than half of the length of the main body portion, creating an overlap when the container is assembled.

6. The packaging container in accordance with claim 5 wherein the overlap of the second closure panels renders the container self-sealing.

7. A packaging container, comprising:

a embossed preformed, rigid unit of U-shaped cross-section having a main body portion with a generally flat bottom wall and integral opposing side walls, and two end closures formed from first closure panels with integral side walls extending from and adjacent to both ends of the main body, and second closure panels with integral side walls-extending from and adjacent to both ends of the first closure panels, the main body side walls being approximately equal in height to the first and second closure panels side walls, the main body and the first closure panels being foldably connected to one another by first fold lines, and first closure panels and the second closure panels being foldably connected to one another by second fold lines, the main body side walls having straight-cut corners at their junctures with the first closure panels and the first closure panels having first straight-cut corners adjacent the main body, the first closure panels side walls having second straight-cut corners adjacent the second closure panels and the second closure panels side walls having straight-cut corners adjacent the first closure panels, the first closure panels being configured for folding generally perpendicular to the main body bottom wall and the second closure panels being configured for folding generally perpendicular to the first closure panels and generally parallel to the main body bottom wall, wherein the first and second closure panels are configured for insertion inside the main body walls, and the length of each second closure panel is greater than half of the length of the main body portion, creating an overlap when the container is assembled.

8. The packaging container in accordance with claim 7 wherein the overlap of the second closure panels renders the container self-sealing.

* * * * *